US007393235B2

(12) United States Patent
Lin

(10) Patent No.: US 7,393,235 B2
(45) Date of Patent: Jul. 1, 2008

(54) ELECTRICAL CONNECTOR

(75) Inventor: Chin-Huang Lin, Jhonghe (TW)

(73) Assignee: Long Chang Technology Co., Ltd., Taipie County (TW)

( * ) Notice: Subject to any disclaimer, the term of this patent is extended or adjusted under 35 U.S.C. 154(b) by 0 days.

(21) Appl. No.: 11/454,048

(22) Filed: Jun. 16, 2006

(65) Prior Publication Data

US 2007/0270022 A1 Nov. 22, 2007

(30) Foreign Application Priority Data

May 22, 2006 (TW) ..... 95208815 U

(51) Int. Cl.
*H01R 4/24* (2006.01)

(52) U.S. Cl. ..... 439/391

(58) Field of Classification Search ..... 439/425, 439/399, 394, 719, 417–419, 347, 259, 410
See application file for complete search history.

(56) References Cited

U.S. PATENT DOCUMENTS

| | | | | | |
|---|---|---|---|---|---|
| 4,312,556 | A * | 1/1982 | Dufau | ..... | 439/399 |
| 5,087,210 | A * | 2/1992 | Myers et al. | ..... | 439/425 |
| 5,154,632 | A * | 10/1992 | Ijiri | ..... | 439/394 |
| 5,419,718 | A * | 5/1995 | Milburn et al. | ..... | 439/578 |
| 5,429,526 | A * | 7/1995 | Ann | ..... | 439/417 |
| 2004/0142592 | A1 * | 7/2004 | Peng | ..... | 439/409 |

* cited by examiner

*Primary Examiner*—Edwin A. León
(74) *Attorney, Agent, or Firm*—Rosenberg, Klein & Lee

(57) ABSTRACT

An electrical connector includes an insulating body, and a plurality of pins. Each of the pins has a contacting part and a piercing part. The piercing part extends from the rear end of the contacting part. There is at least one piercing end formed at the edge of the piercing part. The pins are installed at the insulating body. Thereby, the piercing parts of the pins pierce through the insulating layer of the wire to contact and electrically connect with the conducting lines of the wire in the inner part of the insulating layer. The manufacturing process is simplified, the cost is reduced, and environmental protection standards are met.

13 Claims, 9 Drawing Sheets

ELECTRICAL CONNECTOR

BACKGROUND OF THE INVENTION

1. Field of the Invention

The present invention relates to an electrical connector. In particular, this invention relates to an electrical connector that improves the connection between the pin and the wire. The present invention simplifies the manufacturing process, reduces the cost, and confirms to environmental protection standards.

2. Description of the Related Art

As electronic devices have become smaller and have begun to provide multiple functions, the requirements for the electrical connector have increased. Electrical connectors need to have a powerful signal transmitting ability and a lot of characteristics, such as a smaller and simple structure, etc. Universal serial bus (USB) connectors and D-SUB connectors have become the most common input/output interface.

However, USB connectors and D-SUB connectors adopt a welding method to connect the pin with the wire. The manufacturing process is complex, the cost is high, and pollutants are easily released into the environment during the welding process.

SUMMARY OF THE INVENTION

One particular aspect of the present invention is to provide an electrical connector. A piercing part is located at the rear end of the pin and is integrated with the pin into one piece. The pin is electrically connected with the wire via a piercing method. The manufacturing process is simplified, the cost is lowered, and the environment is protected.

The electrical connector includes an insulating body, and a plurality of pins. Each of the pins has a contacting part and a piercing part. The piercing part extends from the rear end of the contacting part. There is at least one piercing end formed at the edge of the piercing part. The pins are installed at the insulating body.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
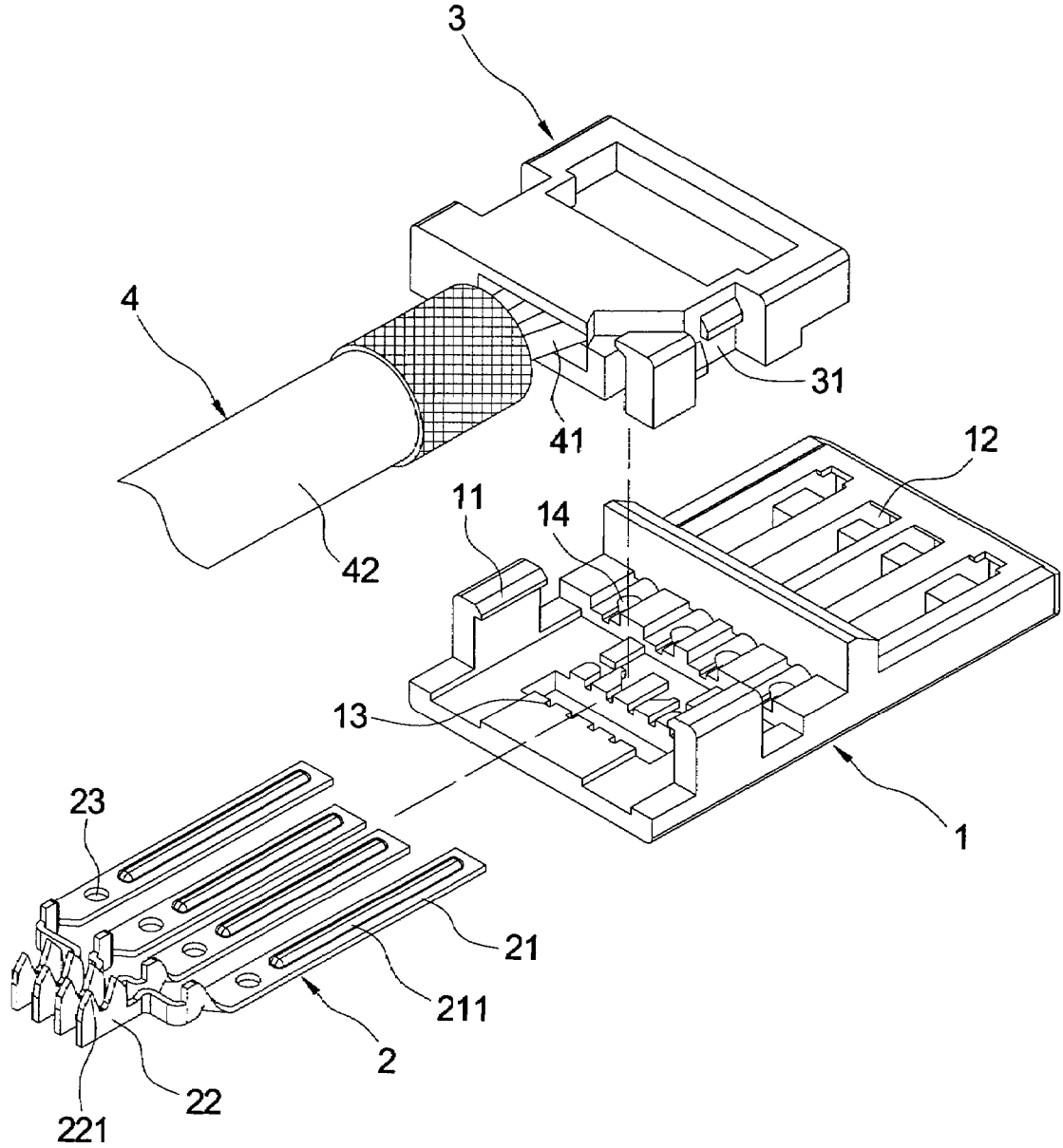
FIG. 1 is an exploded perspective view of the electrical connector of the present invention.
Figure 2:
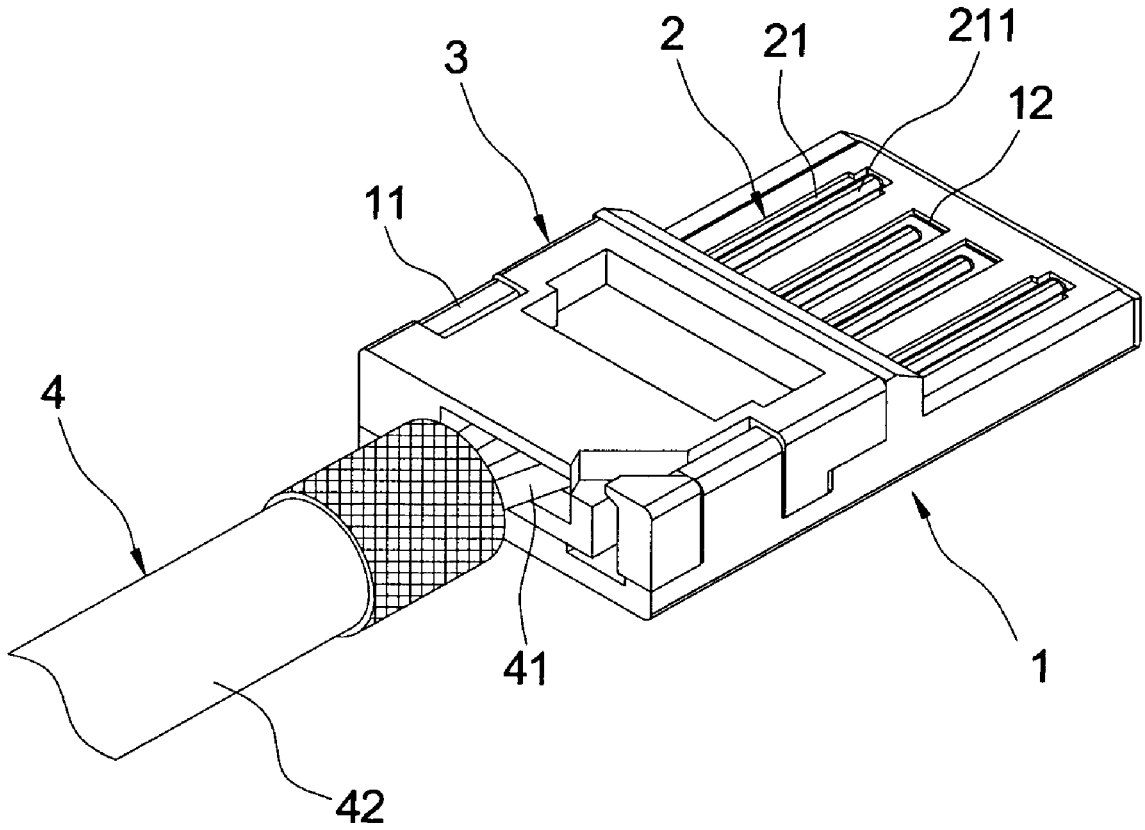
FIG. 2 is an assembly perspective view of the electrical connector of the present invention.
Figure 3:
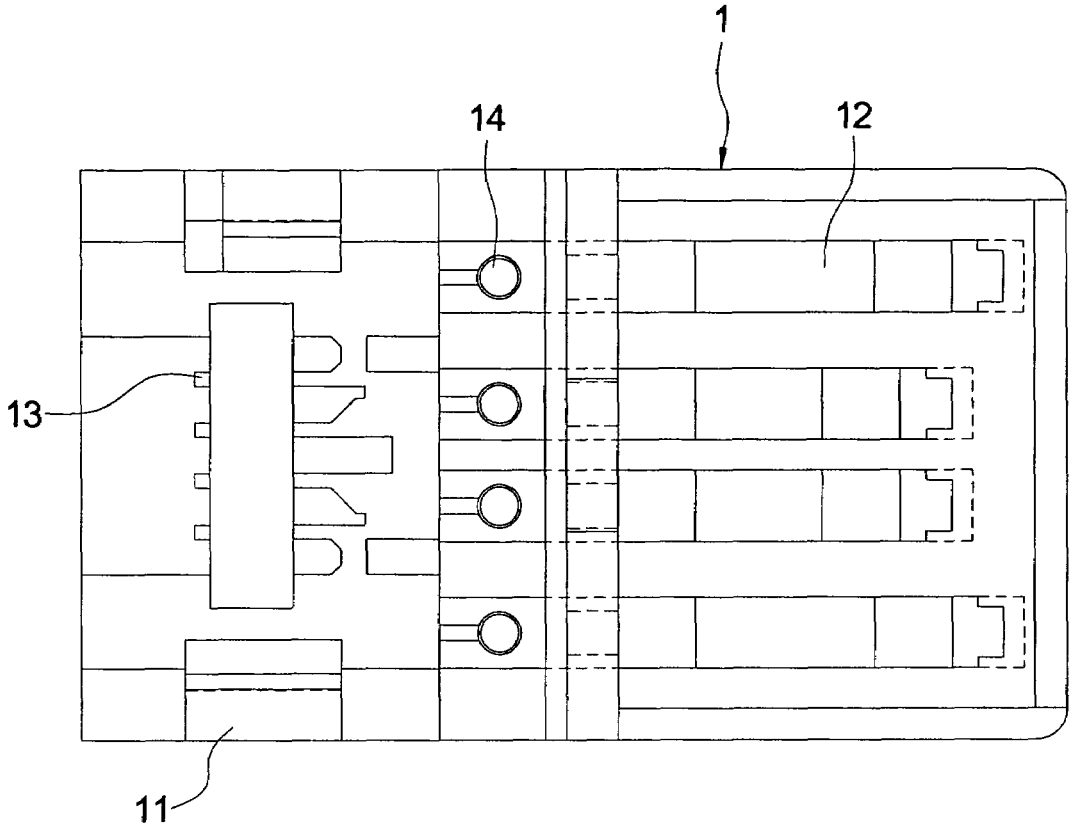
FIG. 3 is a top view of the insulating body of the present invention.
Figure 4:
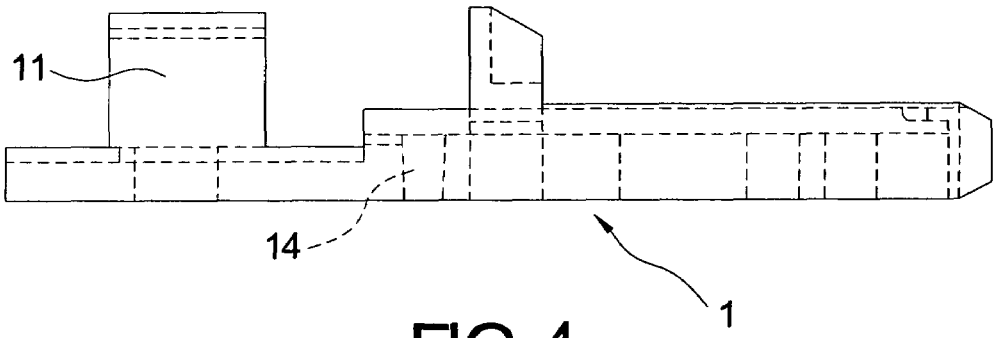
FIG. 4 is a side view of the insulating body of the present invention.

Reference is made to FIGS. 1 and 2. The electrical connector is connected with a wire. In this embodiment, the electrical connector is a USB connector. The electrical connector includes an insulating body 1, a plurality of pins 2, and an upper cover 3. The insulating body 1 is made of a plastic material. The insulating body 1 has a rectangular board shape. A hook 11 (as shown in FIG. 3 and FIG. 4) individually protrudes from the opposite two sides for fastening the upper cover 3. There are a plurality of assembling parts 12 and positioning grooves 13 that are disposed on the top surface of the insulating body 1 and correspond to the pins 2. At the rear end of the assembling parts 12, there is a first positioning hole 14.

Figure 5:
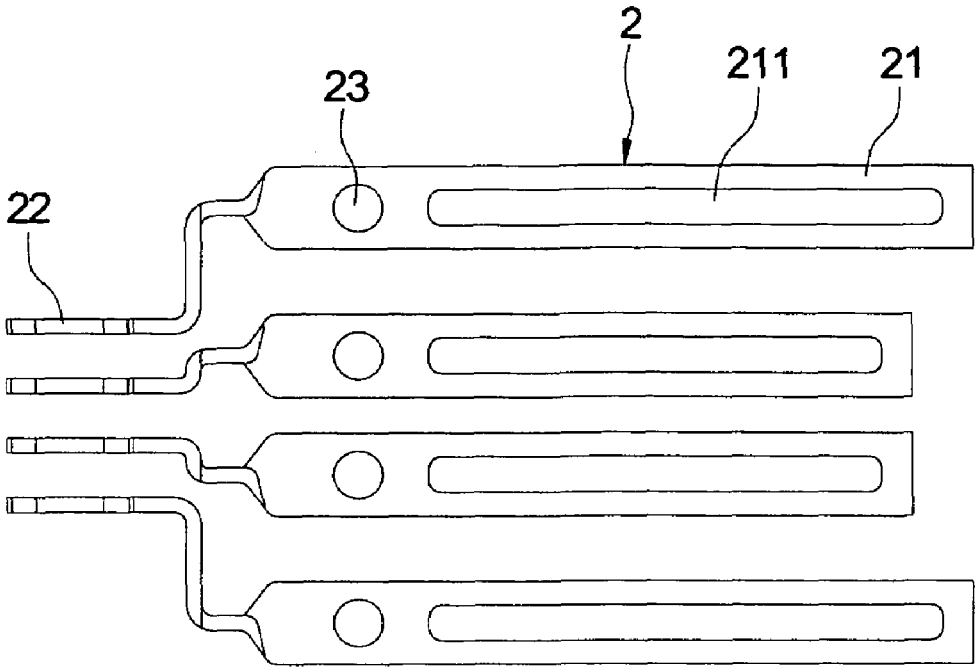
FIG. 5 is a top view of the pins of the present invention.
Figure 6:
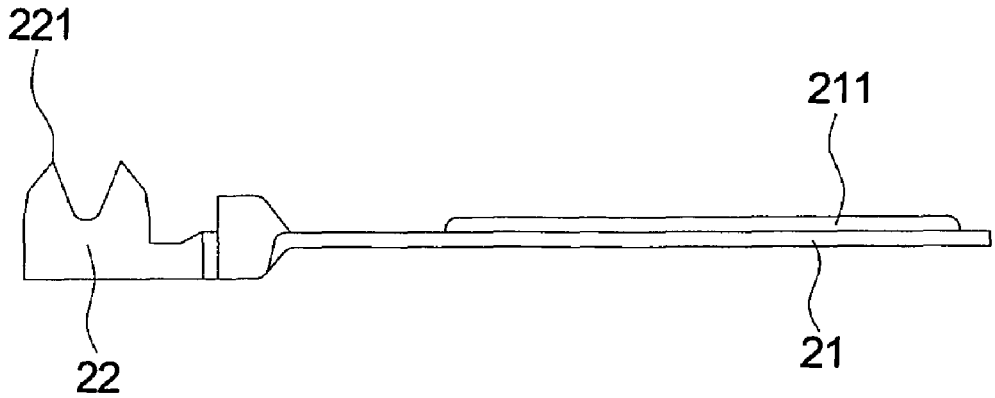
FIG. 6 is a side view of the pins of the present invention.

The pins are made of metal materials having a conducting function. Each of the pins 2 has a contacting part 21 and a piercing part 22 (as shown in FIG. 5 and FIG. 6). The contacting part 21 is a horizontal rectangular flake body and is assembled at the assembling part 12 of the insulating body 1. A convex body 211 is formed at the contacting part 21. The convex body 211 is formed via a punching process and has a bar shape. The convex body 211 extends lengthwise at a proper distance along the contacting part 21 to increase the contacting area of the pin. At the rear end of the contacting part 21, there is a second positioning hole 23 that corresponds to the first positioning hole 14. Bending the rear end of the contacting part 21 forms the piercing part 22. The piercing part 22 is rotated 90 degrees so that the piercing part 22 is a vertical flake body. Two sharp piercing ends 221 are formed at the edge of the piercing part 22. The piercing part 22 is installed in the corresponding positioning groove 13.

Figure 7:
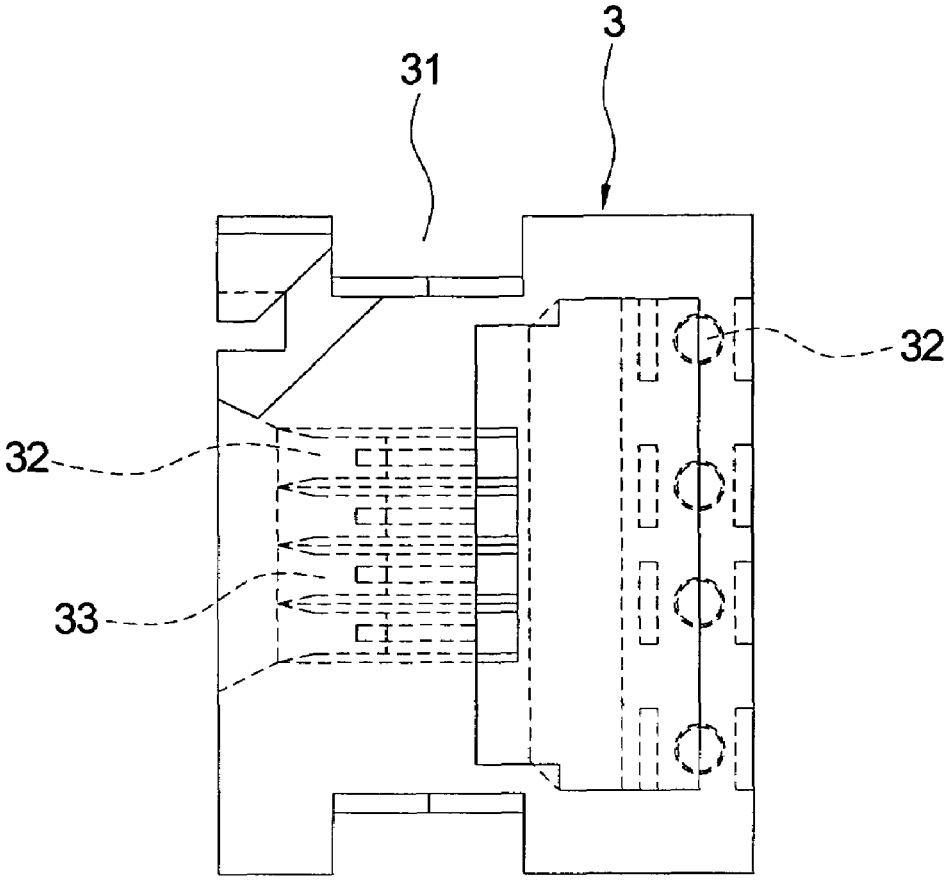
FIG. 7 is a top view of the upper cover of the present invention.
Figure 8:
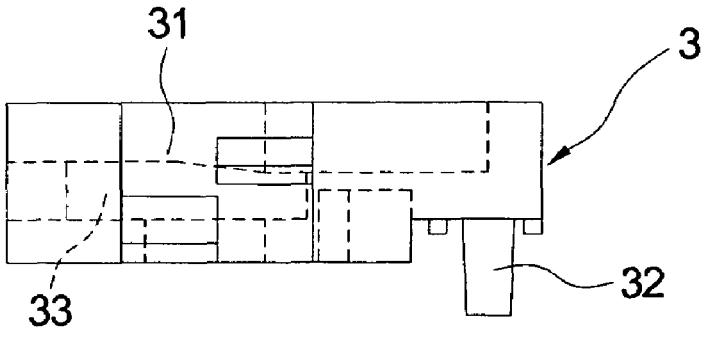
FIG. 8 is a side view of the upper cover of the present invention.
Figure 9:
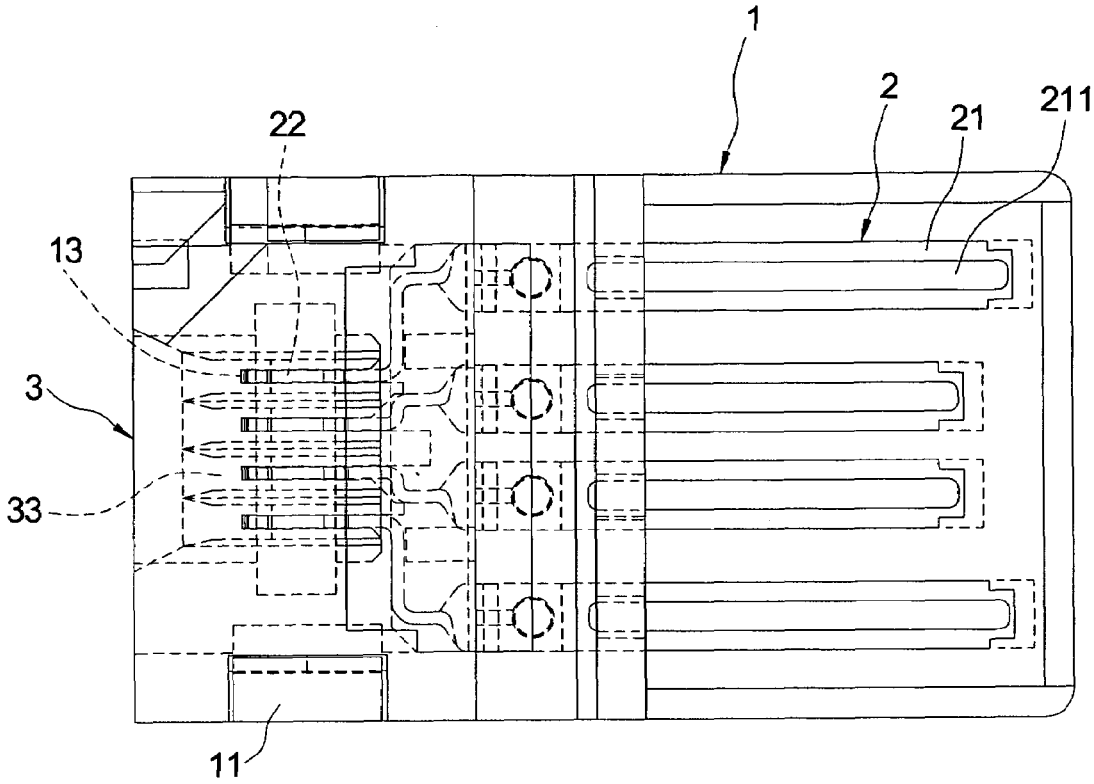
FIG. 9 is a top view of the electrical connector of the present invention.
Figure 10:
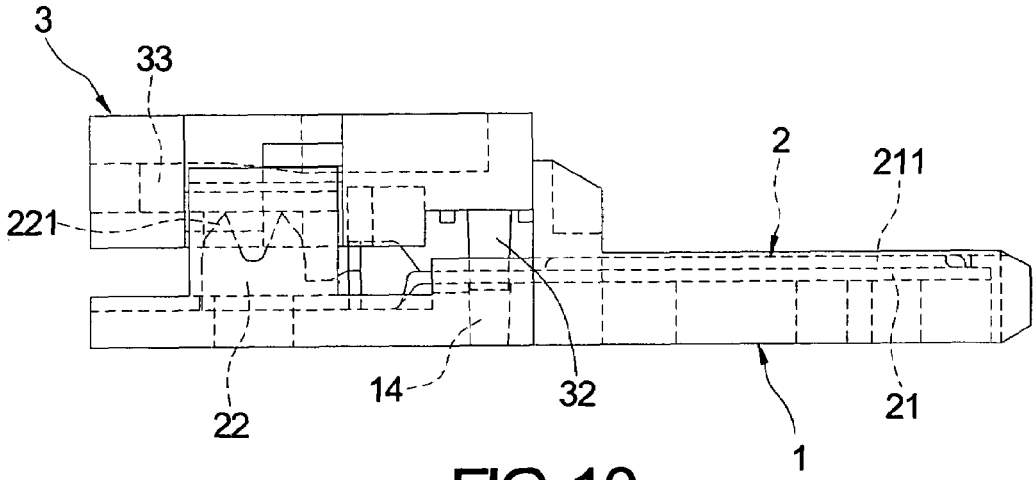
FIG. 10 is a side view of the electrical connector of the present invention.

The upper cover 3 is made of plastic materials. The upper cover 3 is a rectangular board body. On the opposite two sides of the upper cover 3, there is a wedging groove 31 (as shown in FIG. 7 and FIG. 8) that corresponds to the hook 11. There are a plurality of positioning columns 32 located at the bottom surface of the upper cover 3 that are adjacent to the front end. A plurality of wire grooves 33 are formed and disposed in the inner part of the upper cover 3. The upper cover 3 is covered at the rear half part of the insulating body 1. The positioning columns 32 are individually plugged into the second positioning holes of the pins 2 and the first positioning holes 14 of the insulating body 1 so as to position the upper cover 3 and the pins 2 on the insulating body 1. The two hooks 11 are wedged into the two corresponding wedging grooves 31 to make the upper cover 3 steadily cover the insulating body 1. The wire grooves 33 individually correspond to the piercing parts 22 of the pins 2. At this moment, there is a proper gap between the upper cover 3 and the insulating body 1 so that the upper cover 3 can move downward (as shown in FIG. 9 and FIG. 10).

Figure 11:
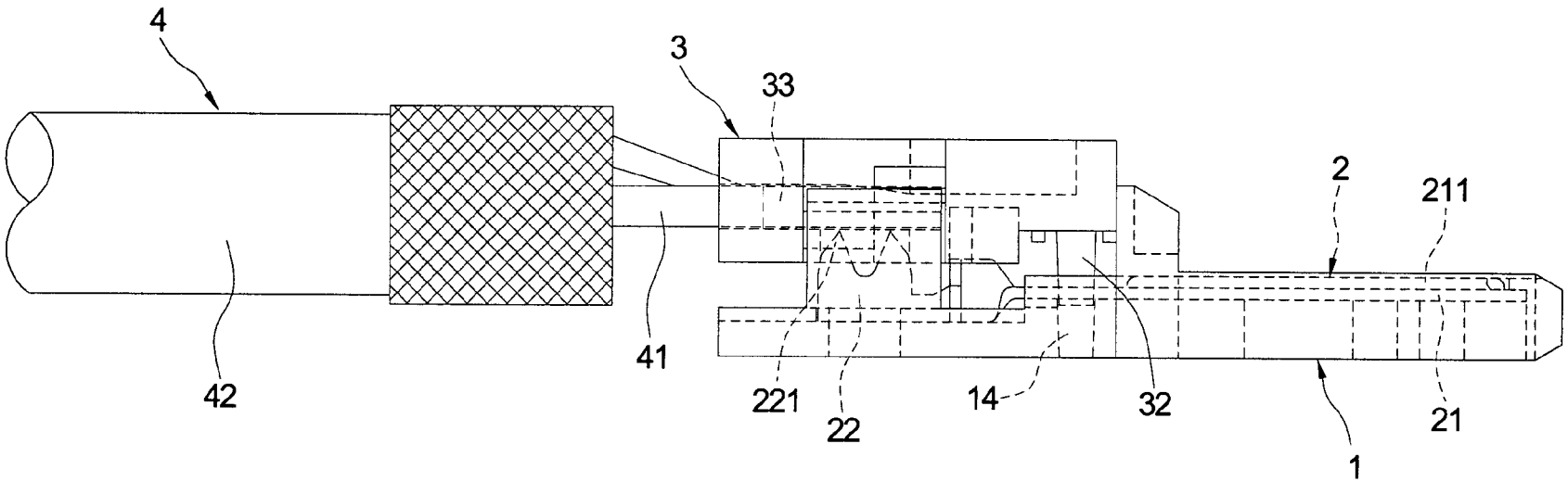
FIG. 11 is a side view of the electrical connector plugging into the wire of the present invention.
Figure 12:
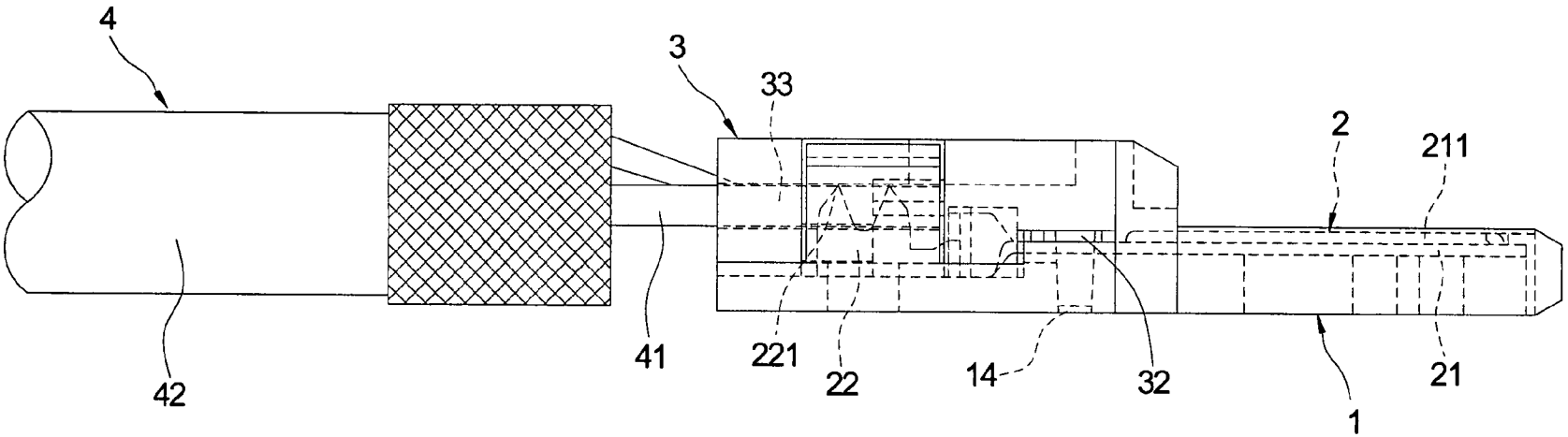
FIG. 12 is a side view of the electrical connector piercing through the wire of the present invention.
Figure 13:
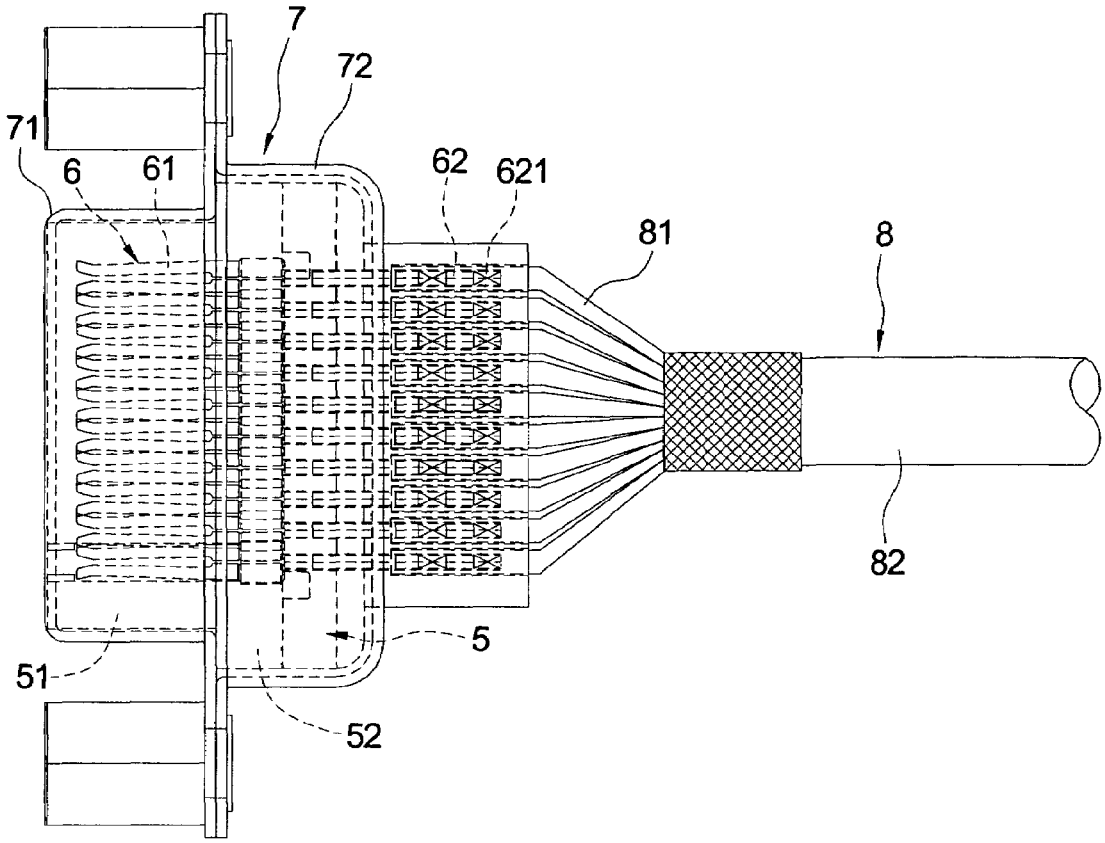
FIG. 13 is a top view of the electrical connector of another embodiment of the present invention.

The wire 4 is composed of a plurality of conducting lines (not shown in the figure), and an insulating layer 41 and a covering layer 42 that are wrapped around the conducting lines (as shown in FIG. 11). The conducting lines and the insulating layer 41 of the wire 4 are plugged into the corresponding wire grooves 33 from the rear end of the upper cover 3. Next, the upper cover 3 is pressed downward (as shown in FIG. 13) to push the conducting lines and the insulating layer 41 to move downward. Therefore, the piercing ends 221 of the piercing parts 22 of the pins 2 are individually pierced through the insulating layer 41 to contact and electrically connect with the conducting lines in the inner part of the insulating layer 41. At the exterior of the electrical connector, a metal shell and a plastic shell are formed.

Figure 14:
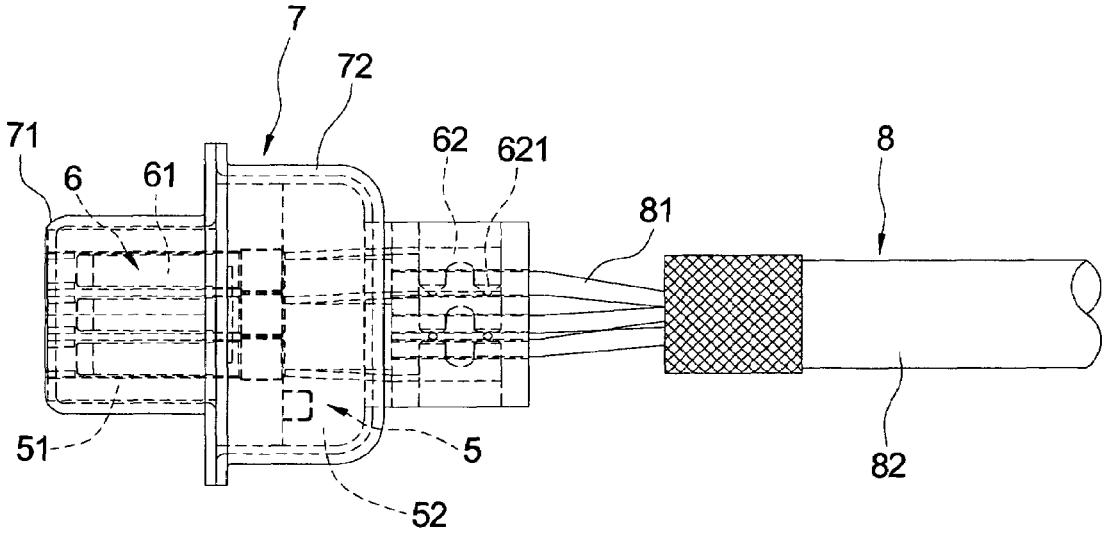
FIG. 14 is a side view of the electrical connector of another embodiment of the present invention.

Reference is made to FIGS. 13 and 14. In this embodiment, the electrical connector is a D-SUB connector. The electrical connector includes an insulating body 5, a plurality of pins 6, and a metal shell 7. The insulating body 5 includes a body front cover 51 and a body rear cover 52. The body front cover 51 and the body rear cover 52 are made of plastic materials.

The pins 6 are located at the body front cover 51 and the body rear cover 52. Each of the pins has a contacting part 61 and a piercing part 62. The contacting part 61 has a pipe shape and is installed in the inner part of the body front cover 51 of the insulating body 5. Bending the rear end of the contacting part 61 forms the piercing part 62. There are two sharp piercing ends 621 formed at the edge of the piercing part 62. The piercing part 62 is assembled at the body rear cover 52 of the insulating body 5. The pins 6 are installed at the insulating body 5 and are disposed upon three lines. The piercing ends 621 of the piercing part 62 of the pins 6 individually face upwards and downwards.

The metal shell 7 includes a metal front cover 71 and a metal rear cover 72. The metal front cover 71 and the metal rear cover 72 are made of metal materials and individually wrap around the body front cover 51 and the body rear cover 52 to provide good protection and an electromagnetic sheltering effect.

The wire 8 is composed of a plurality of conducting lines (not shown in the figure), and an insulating layer 81 and a covering layer 82 that are wrapped around the conducting lines. The conducting lines and the insulating layer 81 of the wire 8 are plugged into the body rear cover 52 of the insulating body 5 via a fixture. Therefore, the piercing ends 621 of the piercing parts 62 of the pins 6 individually pierce through the insulating layer 81 to contact and electrically connect with conducting lines in the inner part of the insulating layer 81.

The present invention integrates the piercing parts 22, 62 with the rear end of the pins 2, 6 into one piece to pierce through the wires 4, 8 and electrically connect with the wires 4, 8. Therefore, it does not adopt the welding process to connect the pins 2, 6 with the wires 4, 8. The manufacturing process is simplified, the cost is reduced, the environment is protected, and the length of the pins 2, 6 is shortened.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An electrical connector, comprising:

an insulating body; and a plurality of pins, wherein each of the pins has a contacting part and a piercing part, the piercing part extends from a rear end of the contacting part, there is at least one piercing end formed at an the edge of the piercing part, and the pins are installed at the insulating body; and, a cover member retentively supporting a plurality of conductors each having a conducting line disposed within an insulating layer, each conductor being captured by the cover against the piercing part of a pin responsive to engagement of the cover member to the insulating body, whereby the piercing part pierces the insulating layer to contact the conducting line;

wherein a plurality of first positioning holes is disposed on the insulating body, and a second positioning hole is located at the rear end of the contacting parts of the pins.

2. The electrical connector as claimed in claim 1, wherein the insulating body has a plurality of assembling parts and positioning grooves that correspond to the pins, the contacting parts of the pins are installed at the assembling parts, and the piercing parts of the pins are installed at the positioning grooves.

3. The electrical connector as claimed in claim 1, wherein the contacting part of the pin has a rectangular flake shape or a pipe shape.

4. The electrical connector as claimed in claim 1, wherein each of the contacting parts of the pins forms a bar convex body.

5. The electrical connector as claimed in claim 1, wherein the piercing part of the pin has a vertical flake shape.

6. The electrical connector as claimed in claim 1, wherein the insulating body comprises a body front cover and a body rear cover, the contacting parts and the piercing parts of the pins are individually installed at the body front cover and the body rear cover of the insulating body, and a metal front cover and a metal rear cover are wrapped with the body front cover and the body rear cover.

7. The electrical connector as claimed in claim 1, wherein the piercing ends of the piercing parts of the pins individually pierce through the insulating layer to contact and electrically connect with conducting lines within the insulating layer.

8. The electrical connector as claimed in claim 1, wherein the electrical connector is a USB connector.

9. The electrical connector as claimed in claim 1, wherein the electrical connector is a D-SUB connector.

10. The electrical connector as claimed in claim 1, wherein the piercing part extends in a parallel direction relative to each conducting line.

11. The electrical connector as claimed in claim 1, wherein the insulating body is covered with an upper cover, there is a wedging groove located at the two sides of the upper cover and there is a hook protruding from the two sides of the insulating body, the two hooks are wedged with two wedging grooves, there are a plurality of wire grooves disposed at the inner part of the upper cover, and the wire grooves individually correspond to the piercing parts of the pins.

12. The electrical connector as claimed in claim 11, wherein there are a plurality of positioning columns protruding from the bottom surface of the upper cover, and the positioning columns are individually plugged into the second positioning holes of the pins and the first positioning holes of the insulating body.

13. An electrical connector, comprising:

an insulating body;

a plurality of pins, wherein each of the pins has a contacting part and a piercing part, the piercing part extends from a rear end of the contacting part, there is at least one piercing end formed at an the edge of the piercing part, and the pins are installed at the insulating body; and, a cover member retentively supporting a plurality of conductors each having a conducting line disposed within an insulating layer, each conductor being captured by the cover against the piercing part of a pin responsive to engagement of the cover member to the insulating body, whereby the piercing part pierces the insulating layer to contact the conducting line;

wherein said insulating body is covered with an upper cover, a wedging groove being disposed on each of two opposite sides of said upper cover and a hook protrudes from each of two corresponding opposite sides of the insulating body, wherein said two hooks are received by said two wedging grooves, there being a plurality of wire grooves disposed on an inner part of the upper cover, each wire groove corresponding to the piercing part of an individual pin, there being a plurality of positioning columns protruding from a bottom surface of the upper cover, said insulating body having a plurality of first positioning holes and each pin having a second positioning hole disposed near the end of the contacting part, wherein the positioning columns are individually plugged into the second positioning holes of the pins and the first positioning holes of the insulating body.

* * * * *